United States Patent [19]

Coch

[11] Patent Number: 4,654,230

[45] Date of Patent: Mar. 31, 1987

[54] METHOD OF IMPACT PLATING SELECTIVE METAL POWDERS ONTO METALLIC ARTICLES

[75] Inventor: Lester Coch, Northport, N.Y.

[73] Assignee: Tru-Plate Process, Inc., Jericho, N.Y.

[21] Appl. No.: 660,402

[22] Filed: Oct. 12, 1984

[51] Int. Cl.[4] ..... B05D 3/12

[52] U.S. Cl. ..... 427/242; 427/328

[58] Field of Search ..... 427/242, 191, 192, 11, 427/328

[56] References Cited

U.S. PATENT DOCUMENTS

| | | | |
|---|---|---|---|
| 2,999,767 | 9/1961 | Clay, Jr. et al. | 427/242 |
| 3,013,892 | 12/1961 | Songas | 427/242 |
| 3,251,711 | 5/1966 | Pottberg et al. | 427/242 |
| 3,268,356 | 8/1966 | Simon | 427/242 |
| 3,328,197 | 6/1967 | Simon | 427/242 |
| 3,400,012 | 9/1969 | Golben | 427/242 |
| 3,442,691 | 5/1969 | Pearson | 427/242 |
| 3,443,985 | 5/1969 | Cutcliffe | 427/242 |
| 3,460,977 | 8/1969 | Golben | 427/242 |
| 3,479,209 | 11/1969 | Clayton | 427/242 |
| 3,494,327 | 2/1970 | Pearson | 118/418 |
| 3,531,315 | 9/1970 | Golben | 427/328 |
| 3,690,935 | 9/1972 | Coch | 427/242 |
| 3,776,186 | 12/1973 | Coch | 118/603 |
| 4,062,990 | 12/1977 | Coch | 427/242 |
| 4,162,680 | 7/1979 | Coch | 118/76 |

OTHER PUBLICATIONS

Perry, R. H. and Chilton, C. H., "Chemical Engineers' Handbook", fifth edition, New York, McGraw-Hill Book Company, 1973, pp. 8-4, 8-5, 21-30.

"Materials in Design Engineering", Materials Selector Issue, vol. 64, No. 5, Oct. 1966, p. 179.

*Primary Examiner*—Evan K. Lawrence

*Attorney, Agent, or Firm*—Burns, Doane, Swecker & Mathis

[57] ABSTRACT

The present invention relates to a method of impact plating selected metal powders onto metallic articles. The powders are non-spherical and are characterized by an elongated, irregular surface which may contain at least one concave portion. Such metal powders are plated onto metallic articles having a Rockwell hardness of at least B-40. The method results in metallic articles having a substantially uniform coating composed of the impact plated metal powders.

22 Claims, 2 Drawing Figures

METHOD OF IMPACT PLATING SELECTIVE METAL POWDERS ONTO METALLIC ARTICLES

BACKGROUND OF THE INVENTION

1. Field of the Invention

The present invention relates to a method of impact plating selective metal powders onto metallic articles.

2. Description of the Related Art

Impact plating, otherwise known as mechanical plating, is a well-established technique for applying powdered coating materials onto discrete articles. For example, U.S. Pat. Nos. 2,640,001 and 2,640,002 disclose methods of applying finely divided metal powder onto discrete articles, such as screws and nails, by placing the articles, the metallic powder, film-forming organic compounds and, optionally, metallic balls, in a rotating mill. The rotation of the mill causes the metal powder to be impacted into a coating on the articles.

The use of water and water soluble organic compounds, rather than a completely organic medium, to plate finely divided metallic powder onto discrete articles is disclosed in U.S. Pat. No. 2,689,808. This type of aqueous environment containing various water soluble organic compounds is also disclosed in other patents such as U.S. Pat. Nos. 3,023,127 and 3,132,043.

As the art of impact plating has progressed, several developments concerning different aspects of the process have been made. For instance, U.S. Pat. Nos. 3,141,780 and 3,164,448 describe the pretreatment of the metallic articles with a flash coating of copper in order to improve the adhesion between the article and the subsequently impact plated metallic powder.

Developments in the chemicals used to obtain the chemical plating, which are commonly known as "promoter chemicals" or "plating accelerators", are marked by such patents as U.S. Pat. No. 2,999,767 wherein various organic ammonium chloride salts are employed to facilitate the plating of brass powder onto lead articles, U.S. Pat. No. 3,328,197 wherein high molecular weight polyoxyethylene glycol is used as a promoter chemical, U.S. Pat. No. 3,460,977 wherein a variety of defined dispersants are used as a promoter chemical and U.S. Pat. No. 3,479,209 wherein water insoluble oxygen-substituted lubricious aromatic compounds are employed as the promoter chemical.

The impact media which is commonly used in the impact plating process has also undergone a transition. In particular, whereas in the earlier techniques, metallic balls were commonly employed, U.S. Pat. No. 3,251,711 describes non-metallic impacting granules which are vitreous, ceramic or mineral in nature, while U.S. Pat. Nos. 3,013,892 and 3,443,985 describe the use of cullet or glass beads, respectively, as the impact media.

With respect to process developments, U.S. Pat. No. 3,268,356 sets forth a technique wherein metallic particles and/or chemical plating promoter is added over substantial portion of the plating cycle. In U.S. Pat. No. 3,400,012, flash coatings are provided on conductive substrates by employing a dissolved metal salt and a driving or plating inducing metal. In U.S. Pat. No. 3,531,315, the articles are plated by successively adding the necessary chemicals into a rotating barrel in the absence of any intervening rinsing operation. More recently, U.S. Pat. No. 3,690,935 discloses a process wherein all the water is recovered and reused and U.S. Pat. No. 4,062,990 sets forth a process wherein all treating and plating chemicals are recovered and reused.

From an apparatus development standpoint, U.S. Pat. Nos. 3,442,691 and 3,494,327 disclose plating systems wherein the plating barrel rotates and vibrates at the same time. U.S. Pat. Nos. 3,726,186 and 4,162,680 disclose the apparatus aspects of the previously mentioned processes wherein water or all the treating and plating materials are captured and reused.

Despite the development of numerous aspects of impact plating, the technique has been practically limited to plating the metals tin, cadmium, zinc or combinations of tin, cadmium and/or zinc onto various substrates. Notwithstanding descriptions in the art that any malleable metal can be impact plated, there has been no known commercial way of impact plating metals such as aluminum, brass or stainless steel. The present invention is directed to a solution of this problem.

OBJECTS AND SUMMARY OF THE INVENTION

Accordingly, it is a general object of the present invention to eliminate or substantially alleviate the noted problems in the art.

It is a more specific object of the present invention to provide a method of impact plating powders of metals having a lower or higher compressive yield strength than zinc, cadmium or tin onto metallic articles.

It is another object of the present invention to provide a method of impact plating using a metal powder which is composed of particles having a shape which substantially differs from spherical particles.

It is a further object of the present invention to provide a method of impact plating using a metal powder having a defined particle size and defined ratios of overall thickness to median thickness and maximum length to maximum width.

These and other objects as well as the scope, nature and utilization of the invention will be apparent from the following summary and Detailed Description of the Present Invention.

In accordance with one aspect, the present invention provides a method of impact plating. The method comprises:

(a) rotating a drum containing (i) metallic articles having a hardness of at least Rockwell B-40

(ii) water, (iii) impact media, (iv) promoter chemical, and (v) powder of a metal having a yield in compression of less than 4,000 psi or greater than 8,000 psi, said powder being composed of particles which will pass through a 100 mesh screen, and which have a ratio of overall thickness to median thickness in the range of from about 1.3:1.0 to about 10.8:1.0 and a ratio of maximum length to maximum width in the range of from about 1.4:1.0 to about 6.4:1.0; said rotating being for a sufficient time at a sufficient speed to impact plate a substantially uniform coating of the metal powder onto the metallic articles; and (b) recovering the impact plated articles from the drum.

DESCRIPTION OF THE PREFERRED EMBODIMENTS

Figure 1:
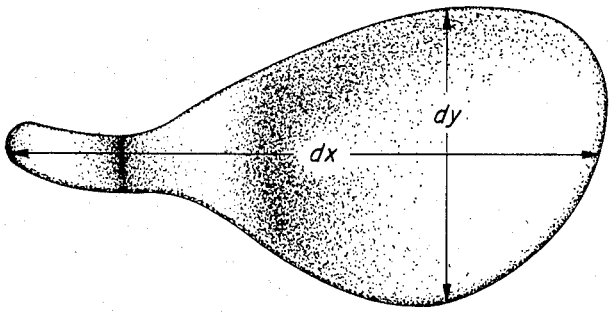
FIG. 1 is a top view of a typical particle used in the present invention with indications of the maximum length and maximum width.

As stated hereinabove, one aspect of the present invention relates to a method of impact plating powdered metal onto metallic articles. The articles are characterized by a hardness of at least Rockwell B-40 and are preferably characterized by a hardness of at least Rockwell C-20. The determination of such Rockwell hardnesses is well described in the literature such as in the "Metals Handbook" published by the American Society of Metals, the contents of which are incorporated by reference. Exemplary materials from which the metallic articles used in the present invention can be made are carbon steel, martensitic stainless steel, austentitic stainless steel, beryllium copper, phosphor bronze, titanium, aluminum, aluminum castings, zinc castings and sintered metal.

The articles can be in any shape which is amenable to impact plating. Illustrative articles are screws, nails, fixtures (e.g., doorknobs, locks, hinges, switch plates, etc.), hand tools, retaining rings, electrical connectors and other electrical equipment.

Before the metallic articles are subjected to impact plating, they are typically prepared in a manner well known in the art. For example, the articles may be subjected to degreasing, such as with an organic solvent or an alkaline compound; surface preparation, such as with an inhibited acidic material; and flashing with a thin coating of an elemental metal, such as copper or tin. These preliminary techniques may be conducted in equipment other than the drum used for impact plating. This is particularly the case with respect to any degreasing step which is employed. Alternatively, to the extent that any surface preparation and flashing is performed, it may be done in the impact plating barrel with or without intervening rinsing steps and with or without capturing the rinse water or the treating materials. In this regard, the combined disclosures of aforementioned U.S. Pat. Nos. 3,164,448, 3,400,012, 3,531,315, 3,690,935 and 4,062,990 are hereby incorporated by reference.

The rotatable impact plating drum or barrel may be any of those known to be effective in achieving impact plating. Suitable drums may be of a variety of sizes depending on the required capacity, may have an incline or horizontal rotational axis and may or may not be provided with internal lifters. Typical impact plating drums are described in the art and particular embodiments of acceptable equipment are described in aforementioned U.S. Pat. Nos. 3,442,691, 3,776,186 and 4,162,680, the contents of which are incorporated by reference.

During the impact plating step, the metallic articles are present in the rotatable drum with water and impact media. These components can be added specifically for the impact plating step or may be present throughout whatever steps, such as surface preparation and flash coating, have previously been conducted in the plating drum. To the extent that the water and impact media has been present in the plating drum for prior steps, additional water and/or impact media may be added to the drum in order to achieve the proper mixture for plating. In this respect, water is typically present in an amount ranging from about 0.4 to about 20.0, preferably from about 1.0 to about 3.5 times the volume of the metallic articles in the plating drum.

The impact media may be any material which is effective to achieve proper plating of the metallic articles. Such impact media may be ceramic or metallic in nature, but is preferably glass beads or glass cullet as described in aforementioned U.S. Pat. Nos. 3,443,985 and 3,013,892, respectively, the contents of which are incorporated by reference. One specific advantage of glass impact media is that different sizes may be selected to obtain the appropriate penetration into concave surfaces of the metallic articles. As one illustration, glass spheres having a specific gravity of 1.9 and a diameter in the range of from 0.006 to 0.014 inches are effective in the impact plating of No. 8 screws. Other formulations of impact media can likewise be selected by those of ordinary skill in the art depending on the particular impact plating which is to be performed. However, as a general guideline the volume ratio of glass beads to articles is in the range of from about 0.5:1.0 to about 10.0:1.0.

A further component present during the impact plating step is the promoter or accelerator chemical. Such promoter chemical can be one or a combination of film-forming agents, surfactants and/or dispersing agents which is typically employed in conjunction with an acid such as sulfuric acid, hydrochloric acid or citric acid. Exemplary chemical compounds which may be used as promoter or accelerator chemicals are described in U.S. Pat. Nos. 3,023,127, 3,132,043, 3,328,197, 3,460,977, 3,479,209, and 3,531,315, the contents of which are incorporated by reference. The amount of promoter or accelerator chemical used for impact plating naturally varies on the particular conditions. For instance, if acid and/or chemicals from previous steps in preparing the metallic articles for plating are useful in the actual impact plating itself, less acid and/or chemical will have to be added to the plating drum immediately before plating is initiated. However, a general range for promoter or accelerator chemical is from about 0.1 to about 20.0, preferably from about 0.3 to about 10.0 grams per square foot of metallic articles and acid is present in an amount sufficient to obtain a pH from about 0.1 to about 5.0.

An important aspect of the present invention resides in the metal powder which is to be impact plated onto the metallic articles. As noted previously, despite allegations in various patents and the literature that the powder of virtually any metal can be impact plated onto metallic articles, it has been found that impact plating onto metallic articles has been practically confined to cadmium, tin and zinc or mixtures thereof. The common belief in the art was to use essentially spherical particles which had a minimum surface area to volume ratio. The belief was that by using such particles, impacting would cause distortion of the particles and exposure of oxide-free metallic surfaces which could readily bond to the substrate and particles previously plated thereon.

The powder used in the method of the present invention is a significant departure from the acknowledged teachings in the art. First, the powder is composed of metals other than the easy to plate metals such as cadmium, tin and zinc. Specifically, the present invention uses powder of a metal having a yield in compression of less than 4,000 psi or greater than 8,000 psi. As may be seen from the information set forth in Table I, metals used to form the powder to be impact plated onto the articles include aluminum, nickel, copper, chromium, 70/30 cartridge brass, and type 316 stainless steel. From this information, it should be apparent to those of ordinary skill in the art that other metals, such as bronze, 65/35 or 87/13 brass and other stainless steels (e.g., those in the 300 and other series), can likewise be used in the present invention.

TABLE I

| METAL | YIELD IN COMPRESSION | DENSITY (grams/cm$^3$) |
|---|---|---|
| ALUMINUM | 1,700 lbs. p.s.i. | 2.7 |
| ZINC | 4,566 lbs. p.s.i.*1 | 7.1 |
| TIN | 5,000 lbs. p.s.i.*2 | 7.3 |
| CADMIUM | 6,000 lbs. p.s.i. | 8.65 |
| NICKEL | 8,500 lbs. p.s.i. | 8.9 |
| COPPER | 10,000 lbs. p.s.i.*3 | 8.96 |
| CHROME | 13,000 lbs. p.s.i. | 7.2 |
| 70/30 CARTRIDGE BRASS | 21,000 lbs. p.s.i. | 8.53 |
| TYPE 316 STAINLESS STEEL | 35,000 lbs. p.s.i. | 8.0 |

*1Converted from 13,000 Megabars per cm$^2$ - e.g., 1 Megabar = 2,248 lbs. Then divide by 6.4 to convert to p.s.i.
*2Ultimate Shear Strength/.6 for Yield in Compression.
*3From Copper Development Association Standards Handbook.

All or substantially all of the metal powder particles can be passed through a 100 mesh screen and can preferably be passed through a 325 mesh screen and can most preferably be passed through a 400 mesh screen.

Figure 2:
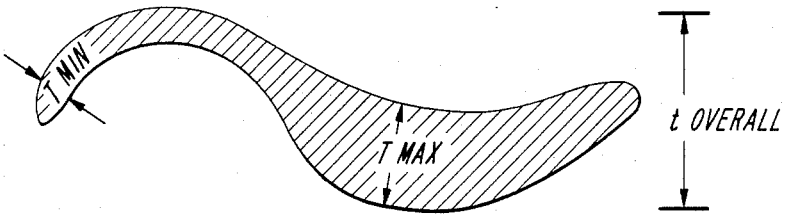
FIG. 2 is a cross-sectional side view with the minimum, maximum and overall thickness indicated thereon of a typical particle used in the present invention whose top view is shown in FIG. 1.

The shape of the particles comprising the metal powder is also a significant departure from the teachings in the art to employ spherical particles. As may be seen from FIGS. 1 and 2, the shape of a typical particle is significantly different than the spherical particles prescribed in the prior art. The particles have a ratio of overall thickness to median thickness in the range of from about 1.3:1.0 to about 10.8:1.0, preferably from about 1.8:1.0 to about 7.8:1.0 and a ratio of maximum length to maximum width in the range of from about 1.4:1.0 to about 6.4:1.0, preferably from about 2.1:1.0 to about 5.8:1.0. To determine these dimensions, a typical particle is selected from the powder and is subjected to microscopic analysis. The overall thickness, the minimum thickness and the maximum thickness can be determined by viewing the particle from the side. The median thickness is determined by adding the minimum thickness and maximum thickness together and dividing the sum by 2. The maximum length (i.e., dx) and maximum width (i.e., dy) can likewise be determined by microscopically analyzing a top view of the particle.

In addition to having the defined ratios which are significantly different from those possessed by spherical or substantially spherical particles, the particles of the present invention generally have one or more concave surfaces which takes up a substantial portion of the surface area of the particle. Illustratively, each concave surface portion, as defined by the inflection points on the surface of the particle wherein the surface changes from concave to convex, is at least about 12.5% of the top surface area as determined by multiplying the maximum length and maximum width. More specifically, each concave surface portion covers from about 12.5% to about 74% of the top surface area.

Since the particles which compose the powder may differ from one another and since microscopic analysis may be time consuming, a simple way of analyzing the particles has been developed. That is, the density of the metal powder is determined and is compared against the density of the bulk metal. This may be done by filling a container with the metal powder to a known volume (e.g., 30 cm$^3$ or 100 cm$^3$) tapping the container once to settle the powder, weighing the container, subtracting the weight of the container from the total weight, and dividing the weight of the powder by the volume occupied by the powder to obtain the density of the powder. If one compares this value with the density of the bulk material (illustrative densities are set forth in Table I), the ratio of powder density to the density of the bulk metal ranges from about 0.1:1.0 to about 0.41:1.0, preferably from about 0.1:1.0 to about 0.35:1.0.

The metal powder of the present invention can be prepared by first atomizing the metal, drying it and flaking it by mechanical means to the appropriate size. Such powders can now be commercially obtained from Atlantic Powdered Metals, Inc. of New York, N.Y. For example, brass powder which may be used in the present invention is available from Atlantic Powdered Metals, Inc. under the name "Richgold".

The conditions under which impact plating is achieved will necessarily depend on the particular situation. For example, while impact plating is typically conducted at ambient temperature, it can be conducted at temperatures in the range of from about 20° to about 50° C., the specific temperature being selected to obtain the desired rate of plating and the desired plating results. Furthermore, if thicker coatings are required, additional increments of materials, especially the promoter or accelerator chemical and the metal powder, may be added at one or more times after impact plating has been initiated. Such an embodiment would naturally require a longer period of plating time than when a thinner coating is required. Typical plating times will be in the neighborhood of about 10 to about 120 minutes, preferably from about 15 to about 90 minutes to obtain coating thickness ranging from about 0.00003 to about 0.0035 inches.

The metal powder may be added directly to the drum or can be formed into an aqueous slurry with or without other ingredients, such as promoter chemical, as set forth in U.S. Pat. No. 4,514,093 to Lester Coch and Kurt Rauch, the contents of which are incorporated by reference.

The speed of the plating barrel may likewise be selected to obtain the best plating results. Generally, however, the peripheral speed of the plating drum will be in the range of from about 15 to about 250 feet per minute.

At the completion of impact plating, the metallic articles may be recovered. This may be achieved by draining the liquid contents from the drum (which may or may not be recycled), rinsing with water (which may or may not be saved), dumping the contents of the drum and separating the plated articles from the impact media, with the latter typically being reused. Alternatively, the contents of the drum can be dumped, the plated articles separated from the residual liquid and impact media and rinsed with water. Other recovery techniques can likewise be employed as will be apparent to those skilled in the art.

The plated articles can then be dried and further treated (e.g., by painting, chromating, phosphating or lacquering), if desired, before they are ultimately used for their intended purpose.

By the method of the present invention, a complete, uniform coating of the metal powder particles can be plated onto the metallic articles with relatively efficient use of the metal powder. Such efficiencies, as determined by the amount of metal powder plated onto the articles compared to the amount added to the drum, range from about 30 to 100%, preferably from about 50 to about 95% and most preferably from about 70 to about 95%. The coating of the impact plated powder is adherent and lustrous and can be used in order to plate metals, such as brass, which would otherwise have to be solution plated using chemicals which might be objectionable if released to the environment.

To obtain a more complete understanding of the present invention, the following Reference Example, Comparative Examples and Examples of the present invention are set forth. In the inventive Examples, the metal powder is of the type previously described and is obtained from Atlantic Powdered Metals, Inc. It should be understood, however, that the invention is not limited to the specific details set forth in the Examples.

REFERENCE EXAMPLE

Into a polyvinyl chloride lined, octagonally shaped plating drum having a base diameter of 9 inches, a mouth diameter of 3.5 inches, an approximate internal volume of 0.2 cubic feet and a rotational axis which tilted approximately 25° from horizontal is placed 0.66 pounds of No. 8 screws made of carbon steel having a Rockwell hardness of B-65 to 80, each screw having a length of approximately 0.5 inch for a total surface area of approximately 0.55 square feet. Into the drum is also placed 325 grams of beads having diameters in the range of from 0.006 to 0.014 inches which are composed of glass having a specific gravity of 1.9, 125 ml of tap water and 2 ml of 66° Baume sulfuric acid. The drum is then rotated at 54 rpm (106 surface feet per minute) for 1 minute.

At this time, 0.1 ml of the sodium salt of an alkyl naphthalene sulfonate available from Petrochemicals Co. Inc. under the name Petro A. A., 0.1 ml of the sodium salt of a sulfonated, caprylic acid carboxylated imidazole derivative available from Miranol Chem. Co., Inc. under the name Miranol J. S. and 0.3 ml of propargyl alcohol are added to the drum and the drum is rotated for 5 additional minutes.

Copper sulfate is then added in an amount of 0.3 gram and the drum is rotated for 4 minutes in order to flash coat the articles whereupon 0.1 gram of stannous chloride is added and the drum rotated for 1 additional minute.

At this time, 2 grams of powdered zinc composed of essentially spherical particles having an average diameter of about 6 microns is added to the drum and the drum is rotated for 25 additional minutes. The drum is stopped and the contents of the drum are analyzed. The screws are found to be substantially uniformly impact plated to a thickness of approximately 0.0002 inch with approximately 90% of the zinc powder actually plated onto the screws.

This Reference Example shows that spherical zinc powder particles can be effectively impact placted onto metallic articles using a standard impact plating procedure.

COMPARATIVE EXAMPLE 1

The procedure of the Reference Example is repeated except that the zinc powder is replaced with 2.3 grams of 70/30 brass powder composed of essentially spherical particles passing through a 325 mesh screen. An examination of the screws at the conclusion of the procedure reveals that no plating has occurred.

EXAMPLE 1

The procedure of comparative example 1 is repeated except that the brass powder is replaced with 2.3 grams of 70/30 brass powder composed of non-spherical particles which pass through a 325 mesh screen and which have a ratio of powder density to metal bulk density of 0.20 as determined by a 100 cubic centimeter sample. A typical brass powder particle has an overall thickness of approximately 10.2 microns, a median thickness of approximately 1.7 microns, a maximum length of approximately 39 microns and a maximum width of approximately 13 microns with 1 concave surface covering about 50% of the top surface area.

At the conclusion of the procedure, an examination of the contents of the drum reveals that the screws are substantailly uniformly plated with a brass coating to an approximate thickness of 0.00016 inch and that approximately 73 % of the brass powder is plated onto the screws.

COMPARATIVE EXAMPLE 2

The procedure of the Reference Example is repeated except that the zinc powder is replaced with 0.8 grams of aluminum powder composed of essentially spherical particles having an average diameter of about 6 microns.

At the conclusion of the procedure, an examination of the contents of the drum reveals that the screws have a non-uniform coating of aluminum whose thickness cannot be measured. Only about 13% of the aluminum powder is plated onto the screws.

EXAMPLE 2

The procedure of comparative example 2 is repeated except that the aluminum powder is replaced with 8.8 grams of aluminum powder composed of non-spherical particles which pass through a 250 mesh screen and which has ratio of powder density to metal bulk density of 0.30 as determined by a 30 cubic centimeter sample. A typical aluminum powder particle has an overall thickness of approximately 5 microns, a median thickness of approximately 2.5 microns, a maximum length of approximately 52 microns and a maximum width of approximately 20 microns with 2 concave surfaces each covering about 25% of the top surface area.

At the conclusion of the procedure, an examination of the contents of the drum reveals that the screws are substantially uniformly plated with an aluminum coating to an approximate thickness in the range of from 0.0001 to 0.00015 inch and that approximately 65% of the aluminum powder is plated onto the screws.

COMPARATIVE EXAMPLE 3

The procedure of the Reference Example is repeated except that the zinc powder is replaced with 2.2 grams of 316 stainless steel powder composed of essentially spherical particles having an average diameter of about 12 microns.

An examination of the screws at the conclusion of the procedure reveals that no plating has occurred.

EXAMPLE 3

The procedure of comparative example 3 is repeated except that the stainless steel powder is replaced with 2.2 grams of 316 stainless steel powder composed of non-spherical particles which pass through a 400 mesh screen and which has ratio of powder density to metal bulk density of 0.16 as determined by a 100 cubic centimeter sample. A typical stainless steel powder particle has an overall thickness of approximately 2.7 microns, a median thickness of approximately 1 micron, a maximum length of approximately 30 microns and a maximum width of approximately 18 microns with 1 concave surface covering about 50% of the top surface area.

At the conclusion of the procedure, an examination of the contents of the drum reveals that the screws are substantially uniformly plated with a stainless steel coating to an approximate thickness of 0.0001 inch and that approximately 40% of the stainless steel powder is plated onto the screws.

COMPARATIVE EXAMPLE 4

The procedure of the Reference Example is repeated except that the amount of sulfuric acid is increased to 4 ml and the zinc powder is replaced with 2.3 grams of 70/30 brass powder composed of essentially spherical particles passing through a 325 mesh screen. An examination of the screws at the conclusion of the procedure reveals that no plating has occurred.

EXAMPLE 4

The procedure of comparative example 4 is repeated except that the brass powder is replaced with 2.3 grams of 70/30 brass powder composed of non-spherical particles which pass through a 325 mesh screen and which has ratio of powder density to metal bulk density of 0.20 as determined by a 100 cubic centimeter sample. A typical brass powder particle has an overall thickness of approximately 10.2 microns, a median thickness of approximately 1.7 microns, a maximum length of approximately 39 microns and a maximum width of approximately 13 microns with 1 concave surface covering about 50% of the top surface area.

At the conclusion of the procedure, an examination of the contents of the drum reveals that the screws are substantially uniformly plated with a brass coating to an approximate thickness of 0.00019 inch and that approximately 80% of the brass powder is plated onto the screws.

COMPARATIVE EXAMPLE 5

The procedure of the Reference Example is repeated except that the amount of sulfuric acid is increased to 4 ml and the zinc powder is replaced with 0.8 grams of aluminum powder composed of essentially spherical particles having an average diameter of about 6 microns.

At the conclusion of the procedure, an examination of the contents of the drum reveals that the screws have a non-uniform coating of aluminum whose thickness cannot be measured. Only about 15% of the aluminum powder is plated onto the screws.

EXAMPLE 5

The procedure of Comparative Example 5 is repeated except that the aluminum powder is replaced with 0.88 grams of aluminum powder composed of non-spherical particles which pass through a 250 mesh screen and which has ratio of powder density to metal bulk density of 0.30 as determined by a 30 cubic centimeter sample. A typical aluminum powder particle has an overall thickness of approximately 5 microns, a median thickness of approximately 2.5 microns, a maximum length of approximately 52 microns and a maximum width of approximately 20 microns with 2 concave surfaces each covering about 25% of the top surface area.

At the conclusion of the procedure, an examination of the contents of the drum reveals that the screws are substantially uniformly plated with an aluminum coating to an approximate thickness of 0.00015 inch and that approximately 72% of the aluminum powder is plated onto the screws.

COMPARATIVE EXAMPLE 6

The procedure of the Reference Example is repeated except that the amount of sulfuric acid is increased to 4 ml and the zinc powder is replaced with 2.2 grams of 316 stainless steel powder composed of essentially spherical particles having an average diameter of about 12 microns. An examination of the screws at the conclusion of the procedure reveals that no plating has occurred.

EXAMPLE 6

The procedure of Comparative Example 6 is repeated except that the stainless steel powder is replaced with 2.2 grams of 316 stainless steel powder composed of non-spherical particles which pass through a 400 mesh screen and which has ratio of powder density to metal bulk density of 0.16 as determined by a 100 cubic centimeter sample. A typical stainless steel powder particle has an overall thickness of approximately 2.7 microns, a median thickness of approximately 1 micron, a maximum length of approximately 30 microns and a maximum width of approximately 18 microns with 1 concave surface covering about 50% of the top surface area.

At the conclusion of the procedure, an examination of the contents of the drum reveals that the screws are substantially uniformly plated with a stainless steel coating to an approximate thickness in the range of from 0.0001 to 0.0012 inch and that approximately 50% of the stainless steel powder is plated onto the screws.

EXAMPLE 7

The procedure of the Reference Example is repeated except that 2 ml of 20% hydrochloric acid is added and the zinc powder is replaced with 0.88 grams of aluminum powder composed of non-spherical particles which pass through a 250 mesh screen and which has ratio of powder density to metal bulk density of 0.30 as determined by a 30 cubic centimeter sample. A typical aluminum powder particle has an overall thickness of approximately 5 microns, a median thickness of approximately 2.5 microns, a maximum length of approximately 52 microns and a maximum width of approximately 20 microns with 2 concave surfaces each covering about 25% of the top surface area.

At the conclusion of the procedure, an examination of the contents of the drum reveals that the screws are substantially uniformly plated with an aluminum coating to an approximate thickness in the range of from 0.00015 to 0.0002 inch and that approximately 78% of the aluminum powder is plated onto the screws.

EXAMPLE 8

The procedure of the Reference Example is repeated except that 2 ml of 20% hydrochloric acid is added and the zinc powder is replaced with 2.2 grams of 316 stainless steel powder composed of non-spherical particles which pass through a 400 mesh screen and which has ratio of powder density to metal bulk density of 0.16 as determined by a 100 cubic centimeter sample. A typical stainless steel powder particle has an overall thickness of approximately 2.7 microns, a median thickness of approximately 1 micron, a maximum length of approximately 30 microns and a maximum width of approximately 18 microns with 1 concave surface covering about 50% of the top surface area.

At the conclusion of the procedure, an examination of the contents of the drum reveals that the screws are substantially uniformly plated with a stainless steel coating to an approximate thickness of 0.00015 inch and that approximately 60% of the stainless steel powder is plated onto the screws.

Although the invention has been described with preferred embodiments, it is to be understood that variations and modifications may be resorted to as will be apparent to those skilled in this art. Such variations are to be considered within the scope of the following claims.

I claim:

1. A method of impact plating powdered metal onto metallic articles comprising:
(a) rotating a drum containing
(i) metallic articles having a hardness of at least Rockwell B-40,
(ii) water,
(iii) impact media,
(iv) promoter chemical, and
(v) powder of a metal having a yield in compression of less than 4,000 p.s.i. or greater than 8,000 p.s.i., said powder being composed of particles having two opposed principal surfaces each of which has a concave portion which will pass through a 100 mesh screen and which have a ratio of overall thickness to median thickness in the range of from about 1.8:1.0 to about 10.8:1.0 and a ratio of maximum length to maximum width in the range of from about 1.4:1.0 to about 6.4:1.0, said rotating being for a sufficient time at a sufficient speed to impact plate a substantially uniform coating of the metal powder onto the metallic articles; and
(b) recovering the impact plated articles from the drum.

2. The method of claim 1 wherein the metallic articles have a hardness of at least as great as Rockwell C-20.

3. The method of claim 1 wherein the metallic articles are composed of a material selected from the group consisting of carbon steel, martensitic stainless steel, austentitic stainless steel, beryllium copper, phosphor bronze and titanium.

4. The method of claim 1 wherein the impact media is comprised of glass beads.

5. The method of claim 4 wherein the impact media is comprised of glass beads of at least two different sizes.

6. The method of claim 1 wherein the metal powder is composed of powder of a metal or metal alloy selected from the group consisting of stainless steel, aluminum, brass, nickel, copper, chromium, bronze and mixtures thereof.

7. The method of claim 1 wherein the metal powder particles have a ratio of overall thickness to median thickness in the range of from about 1.8:1.0 to about 7.8:1.0.

8. The method of claim 1 wherein the metal powder particles have a ratio of maximum length to maximum width in the range of from about 2.1:1.0 to about 5.8:1.0.

9. The method of claim 1 wherein the metal powder particles have concave surface portions each of which covers from about 12.5 to about 74% of the top surface area.

10. The method of claim 1 wherein the metal powder is composed of particles which will pass through a 325 mesh screen.

11. The method of claim 1 wherein the metal powder is composed of particles which will pass through a 400 mesh screen.

12. The method of claim 1 wherein the metal powder is placed in the drum in the form of a slurry.

13. The method of claim 1 wherein the metallic articles are selected from the group consisting of aluminum castings, zinc castings and sintered metals.

14. A method of impact plating powder metal onto metallic articles comprising:
(a) rotating a drum containing
(i) metallic articles having a hardness of at least Rockwell B40,
(ii) water,
(iii) impact media,
(iv) promoter chemical, and
(v) powder of a metal having a yield in compression of less than 4,000 p.s.i. or greater than 8,000 p.s.i., said powder being composed of particles having two opposed principal surfaces each of which has a concave portion and which will pass through a 100 mesh screen and which have a ratio of powder density to the density of the bulk metal in the range of from about 0.1:1.0 to about 0.41:1.0, said rotating being for a sufficient time at a sufficient speed to impact plate a substantially uniform coating of the metal powder on to the metallic articles; and
(b) recovering the impact plated articles from the drum.

15. The method of claim 14 wherein the metallic articles have a hardness of at least as great as Rockwell C-20.

16. The method of claim 14 wherein the metallic articles are composed of a material selected from the group consisting of carbon steel, martensitic stainless steel, austentitic stainless steel, beryllium copper, phosphor bronze and titanium.

17. The method of claim 14 wherein the impact media is comprised of glass beads.

18. The method of claim 17 wherein the impact media is comprised of glass beads of at least two different sizes.

19. The method of claim 14 wherein the metal powder is composed of powder of a metal or metal alloy selected from the group consisting of stainless steel, aluminum, brass, nickel, copper, chromium, bronze and mixtures thereof.

20. The method of claim 14 wherein the metal powder is composed of particles which will pass through a 325 mesh screen.

21. The method of claim 14 wherein the ratio of powder density to the density of the bulk metal is in the range of from about 0.1:1.0 to about 0.35:1.0.

22. The method of claim 14 wherein the metallic articles are selected from the group consisting of aluminum castings, zinc castings and sintered metals.

* * * * *